US005858608A

United States Patent [19]

Corden et al.

[11] Patent Number: 5,858,608

[45] Date of Patent: Jan. 12, 1999

[54] DIFFUSION TRANSFER PHOTOSENSITIVE FILM UNIT FOR SILVER TRANSFER IMAGE

[75] Inventors: Barry B. Corden, Boston; Fredric N. Cramer, Wayland; Paul E. Nangeroni, Avon, all of Mass.

[73] Assignee: Polaroid Corporation, Cambridge, Mass.

[21] Appl. No.: 953,867

[22] Filed: Oct. 16, 1997

[51] Int. Cl.[6] ..... G03C 1/825; G03C 1/83; G03C 8/52; G03C 8/06

[52] U.S. Cl. ..... 430/233; 430/220; 430/227; 430/234; 430/510; 430/517

[58] Field of Search ..... 430/220, 227, 430/233, 234, 510, 517

[56] References Cited

U.S. PATENT DOCUMENTS

| | | | |
|---|---|---|---|
| 2,543,181 | 2/1951 | Land | 95/8 |
| 3,647,437 | 3/1972 | Land | 430/220 |
| 3,758,376 | 9/1973 | Beckner et al. | 430/510 |
| 4,039,333 | 8/1977 | Shinagawa et al. | 96/84 R |
| 4,078,933 | 3/1978 | Sugiyama et al. | 96/84 R |
| 4,294,917 | 10/1981 | Postle et al. | 430/522 |
| 4,312,937 | 1/1982 | Kasper et al. | 430/220 |
| 4,489,152 | 12/1984 | Oberhauser et al. | 430/229 |
| 4,558,002 | 12/1985 | Aotsuka et al. | 430/538 |
| 4,563,406 | 1/1986 | Ohbayashi et al. | 430/513 |
| 4,615,966 | 10/1986 | Borror et al. | 430/221 |
| 4,749,611 | 6/1988 | Furuya | 428/229 |
| 4,751,174 | 6/1988 | Toya | 430/502 |
| 4,755,454 | 7/1988 | Aotsuka et al. | 430/538 |
| 4,957,856 | 9/1990 | Suematsu et al. | 430/518 |
| 4,990,432 | 2/1991 | Komatsu et al. | 430/378 |
| 5,234,804 | 8/1993 | Sato et al. | 430/538 |
| 5,246,823 | 9/1993 | Shuman | 430/510 |
| 5,252,424 | 10/1993 | Sato et al. | 430/138 |
| 5,318,885 | 6/1994 | Shuman | 430/510 |
| 5,422,233 | 6/1995 | Eckert et al. | 430/466 |
| 5,460,931 | 10/1995 | Tanaka et al. | 430/538 |
| 5,665,528 | 9/1997 | Wariishi et al. | 430/516 |

*Primary Examiner*—Richard L. Schilling
*Attorney, Agent, or Firm*—Jennifer A. Kispert

[57] ABSTRACT

There are described diffusion transfer photosensitive film units which include a novel antihalation layer comprising an antihalation material, titanium dioxide and a binder. Diffusion transfer film units prepared according to the invention provide silver images of enhanced resolution, film speed and sharpness.

21 Claims, 1 Drawing Sheet

DIFFUSION TRANSFER PHOTOSENSITIVE FILM UNIT FOR SILVER TRANSFER IMAGE

This application is directed to photography and, more particularly, to diffusion transfer photographic film units and processes wherein a silver transfer reflection print is provided. The diffusion transfer photographic film units include a novel antihalation layer comprising an antihalation material, titanium dioxide and a binder.

BACKGROUND OF THE INVENTION

Diffusion transfer photography is well known and has been utilized to provide "instant" images in black and white in both a peel-apart format and an integral format. For example, U.S. Pat. No. 2,543,181 describes instant peel-apart black and white silver transfer films and U.S. Pat. No. 4,489,152 describes instant integral black and white silver transfer films.

Diffusion transfer photographic film units which include photosensitive silver halide for forming images typically comprise a support carrying a photosensitive silver halide emulsion, a silver halide solvent, a silver reducing agent for converting the exposed silver halide to metallic silver and an alkaline activator to obtain a pH at which the silver halide can be effectively developed. A visible image is formed in these materials by exposing the photosensitive silver halide to an imagewise pattern of activating light to form a latent image, dissolving the unexposed silver halide, transferring the dissolved unexposed silver halide to an image-receiving layer and reducing the transferred unexposed silver halide to form a positive image in reduced silver.

It is well known in the art that light used to expose the photosensitive silver halide emulsion of a diffusion transfer photographic film unit may be diffusely transmitted therethrough to the support and, then be reflected back to the emulsion causing it to be reexposed. Given the distance of the support and the interfaces (of the other layers of the film unit between the support and the emulsion layer) from the emulsion layer, the reexposure of the emulsion occurs at points laterally removed from the initial exposure, hence, with reexposure by such reflected light, a "halo" appears around the site of initial exposure of the emulsion. As will be appreciated by one of skill in the relevant art, the halo effect or "halation" reduces the resolution or sharpness of the film and, accordingly, of the resultant image produced by such film.

As would be understood by those of skill in the art, halation may be substantially prevented or reduced by absorbing any light which may be transmitted by the photosensitive silver halide emulsion layer. It is generally known in the art to prevent halation by, for example, coating the support of the film unit remote from where the exposure is made with either dyes or pigments, or coating an antihalation layer which contains gelatin and dyes or silver between the support of the film unit remote from where the exposure is made and the photosensitive silver halide emulsion layer. Generally, the antihalation dyes incorporated within an antihalation layer are either bleached, decolorized or removed from the layer after photographic processing, e.g., to prevent its color from reappearing in time as it is slowly reoxidized, while antihalation dyes or pigments incorporated in the support remain.

U.S. Pat. No. 4,039,333 is directed to an antihalation layer and describes photographic materials for use in conventional photography which include a combination of at least two particular binders together with an antihalation material, e.g., carbon black, which provide improved antihalation.

U.S. Pat. No. 4,751,174 is directed to a silver halide photographic material for use in conventional photography and describes the inclusion of a light-insensitive silver halide emulsion layer between a light-sensitive silver halide emulsion layer and the support which decreases halation.

U.S. Pat. No. 4,957,856 is directed to a subbing layer having a decoloring capable antihalation function and describes a silver halide photographic material for use in conventional photography which includes the subbing layer which comprises a binder, a polymer, i.e., mordant, described therein, a dye described therein and a surface active agent. As reported therein, the particular mordant and dye combination improves the processing time decolorization.

U.S. Pat. No. 4,990,432 is directed to a silver halide photographic light-sensitive material for use in conventional photography and which includes a reflective support having a transmission density of not more than 0.8, a silver halide emulsion layer and an antihalation layer formed closer to the support than the silver halide emulsion layer. As reported therein, the antihalation layer prevents any reflected light incident into the silver halide emulsion layer.

U.S. Pat. No. 5,318,885 is directed to an antihalation layer and describes a photographic element for use in conventional photography which includes a reflective support, one or more photosensitive silver halide emulsion layers, and a colored, i.e., blue or gray grains of silver in the form of platelets, antihalation layer interposed between the support and the photosensitive layers.

U.S. Pat. No. 5,665,528 is directed to a quickly decolorized new antihalation dye which is incorporated in an antihalation layer of a silver halide photographic material that is conventionally processed.

Diffusion transfer color photographic integral-type film units are known in the art, such as described, for example, in U.S. Pat. No. 5,422,233, which include layers comprising image-forming materials, e.g., dye developers, interposed between an opaque support and a photosensitive silver halide emulsion layer, which may also function as antihalation layers given the light absorption ability of the dye developers. Black and white diffusion transfer photographic film units, by definition, do not contain such color image-forming materials and, therefore, generally contain some provision for antihalation.

The integral black and white instant films described in U.S. Pat. No. 4,489,152 include an opaque layer, i.e., carbon black and polyvinylpyrrolidone, between the silver halide emulsion layer and the image-receiving layer so that the film unit may be developed outside the camera, and a light-reflecting layer, i.e., a white layer of titanium dioxide, positioned between the carbon black layer and the image-receiving layer to provide a white background against which the silver transfer image may be viewed. It would be understood by those of skill in the relevant art that the carbon black layer disclosed therein would be able to function as an antihalation layer, i.e., absorb substantially all of, if not all of, the light which passed through the emulsion layer during photoexposure.

U.S. Pat. No. 4,078,933 is directed to a silver halide photographic light-sensitive element for use in conventional photography which includes at least one silver halide emulsion layer and at least one hydrophilic colloid layer containing at least one dye wherein the dye is useful in antihalation and can be decolorized readily and completely.

According to the description provided therein, to be satisfactory, the subject dyes must be photographically inert, have a good mordanting property, i.e., remain in the layer, and be decolorized or removed by dissolving during photographic processing, i.e., good bleachability.

U.S. Pat. No. 4,294,917 is directed to a dye antihalation layer and describes a photographic silver halide material for use in conventional photography which includes in at least one layer a solid dispersion of a water-insoluble antihalation dye. As reported therein, after completion of the conventional photographic processing, no dye in the antihalation underlayer was visible and, the dye was completely and irreversibly destroyed in the silver halide developing solution and no discolouration of any of the processing solutions was visible.

It is known in the art that use of antihalation materials may result in a loss of emulsion sensitivity or speed. Methods have been devised to reduce such losses in speed associated with the use of antihalation materials, by, for example, incorporating a layer of a light-reflecting pigment, such as, for example, titanium dioxide, e.g., in between the support containing the antihalation materials and the photosensitive silver halide emulsion layer of the film unit, or, in between the antihalation layer and the photosensitive silver halide emulsion layer, preferably, adjacent the photosensitive silver halide emulsion layer. The reflecting layer reflects back substantially all of the exposure light to the silver halide emulsion and, given the proximity of the reflecting layer to the photosensitive silver halide emulsion layer, causes reexposure to made in substantially the same point as the original exposure, hence, preventing "halo" formation, such as described, for example, in U.S. Pat. No. 4,563,406 which describes a photographic support coated with, in succession, a colorant layer (antihalation layer), a white pigment layer and a silver halide emulsion layer; or, U.S. Pat. No. 4,615,966 which describes a diffusion transfer photographic instant film unit which includes a light-reflecting spacer layer disposed between a silver halide layer and the associated layer of image dye-providing material to increase effective film speed as a result of the reflection of light back to the silver halide.

While such methods of preventing or reducing halation in photographic elements have been found to provide advantageous results as are described in the above-mentioned patents, nevertheless their performance in some photographic systems is not completely satisfactory. For example, in some diffusion transfer photographic systems, the use of such methods have been found to contribute to undesirable silver image resolution and speed loss thereby adversely affecting the aesthetic qualities of the final photograph.

It would be desirable to have diffusion transfer photographic black and white film units which include suitable antihalation materials, and which, at the same time, provide suitable film speed and resolution in the finished photograph, and suitable sharpness as visually perceived.

As the state of the art for diffusion transfer photographic film units continues to move forward, new techniques and materials continue to be developed by those of skill in the art in order to meet the performance criteria required of such materials. The present invention is drawn to novel diffusion transfer black and white photosensitive film units which include an antihalation layer comprising an antihalation material, titanium dioxide and a binder; an aqueous alkaline processing composition which includes a suitable amount of a light-reflecting pigment, preferably, titanium dioxide, to form a light-reflecting layer during photographic processing which provides a white background against which to view the final image; a silver reducing agent; and a silver halide solvent.

SUMMARY OF THE INVENTION

There is provided according to the invention a diffusion transfer photosensitive black and white film unit comprising:

a photosensitive element which includes a support and carried by the support, in succession, an antihalation layer comprising from about 1.5% to about 25% by weight of an antihalation material, from about 30% to about 50% by weight of titanium dioxide and from about 25% to about 68.5% by weight of a binder, and a photosensitive silver halide layer;

an image-receiving element in superposed relationship or adapted to be placed in superposed relationship with the photosensitive element so as to receive image silver released from the photosensitive element and thereby form an image, wherein the image-receiving element includes a transparent support and carried by the transparent support, an image-receiving layer comprising a silver nucleating material;

means for providing an aqueous alkaline processing composition comprising an amount of a light-reflecting pigment capable of forming a light-reflecting layer during photographic development which provides a white background against which to view the final image;

a silver reducing agent; and a silver halide solvent.

In a preferred embodiment the opaque support of the photosensitive element carries, in succession, a polymeric acid layer, a timing layer, a spacer layer, an interlayer, an antihalation layer comprising from about 1.5% to about 25% by weight of an antihalation material, from about 30% to about 50% by weight of titanium dioxide and from about 25% to about 68.5% by weight of a binder, a photosensitive silver halide layer and a topcoat layer; the transparent support of the image-receiving element carries, in succession, an image-receiving layer comprising a silver nucleating material, an undercoat layer comprising a silver image toning material, and an overcoat layer comprising a material capable of clearing the light-absorbing capacity of the optical filter agents incorporated in the aqueous alkaline processing composition; and the processing composition includes the silver reducing agent and the silver halide solvent.

In operation, the film units of the present invention are exposed to an imagewise pattern of electromagnetic radiation through the transparent support of the image-receiving element and subsequently developed in the presence of alkali whereby there is formed in the image-receiving layer a visible image in metallic silver.

More particularly, the exposed photosensitive silver halide, when developed with the aqueous alkaline processing composition released into the film unit from the pod, which is incorporated in the film unit, is reduced to metallic silver and remains in its original location in the film unit whereas the unexposed photosensitive silver halide is complexed by the silver halide solvent and transfers to the image-receiving layer. At the nucleating sites in the image-receiving layer, the soluble silver complex is developed and the complexed silver is reduced to metallic silver. A light-reflecting layer is provided to the exposed film unit from the processing composition during photographic processing which provides the white background against which the final image is viewed.

During exposure, light which is diffusely transmitted through the photosensitive silver halide emulsion layer is partially reflected back into the emulsion layer at about the same point of original exposure by the titanium dioxide particles present in the antihalation layer which is positioned adjacent to the emulsion layer nearer the, e.g., opaque, support.

Moreover, any light used to expose the film unit that is diffusely transmitted through the photosensitive silver halide emulsion layer, as well as through the antihalation layer and that is reflected back from the, e.g., opaque support, or the interfaces of the other layers between the antihalation layer and the, e.g., opaque support, is substantially absorbed by the antihalation material of the antihalation layer. The presence of the titanium dioxide particles within the antihalation layer effectively increase the path length of the reflected light such that the reflected light has a greater probability of interacting with one or more of the antihalation dyes and thus being absorbed and therefore being prevented from reentering the photosensitive silver halide emulsion layer to result in halation.

The positioning of the light-reflecting layer with respect to the antihalation layer in the processed photographic laminates of the invention removes the need to bleach, decolorize or remove the antihalation material therefrom.

It has been found that the antihalation layer utilized according to the present invention can minimize or virtually eliminate undesired halation in the photosensitive silver halide emulsion layer while providing suitable film speed and resolution, and suitable sharpness as visually perceived.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

Figure 1:
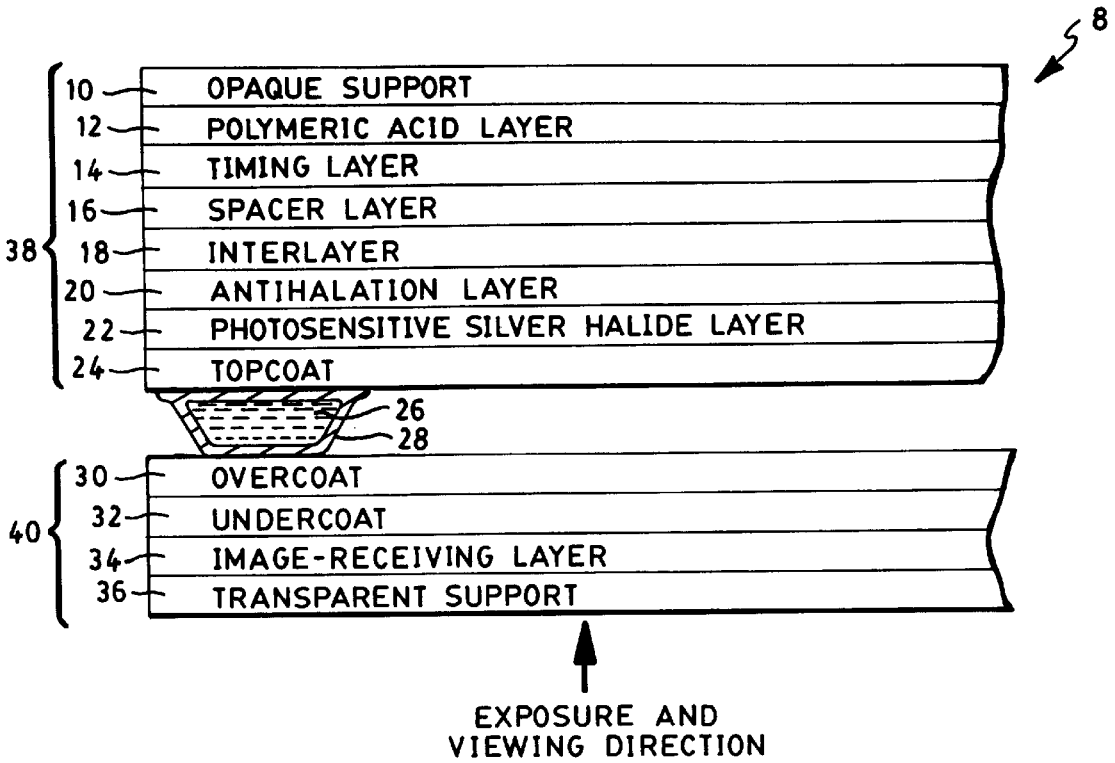
FIG. 1 is an enlarged schematic cross-sectional view of an arrangement of essential elements of a preferred film unit of the present invention.

Referring now to FIG. 1, there is seen a preferred embodiment of a diffusion transfer film unit 8 comprising a photosensitive element 38 and an image-receiving element 40. As illustrated, photosensitive element 38 includes an opaque support 10, a polymeric acid layer 12, a timing layer 14, a spacer layer 16, an interlayer 18, an antihalation layer 20, a photosensitive silver halide layer 22 and a topcoat 24; and image-receiving element 40 includes an overcoat 30, an undercoat 32, an image-receiving layer 34 and a transparent support 36. Each of the layers carried by opaque support 10 and transparent support 36 functions in a predetermined manner to provide desired diffusion transfer photographic processing as is known in the art. Also as illustrated, the alkaline environment required for photographic development is provided by an aqueous alkaline processing composition 26 which is released from the rupturable container or pod 28 positioned between layers 24 and 30.

Opaque support 10 and transparent support 36 may be of any suitable material. Any suitable support known in the relevant art may be employed. Specific examples of suitable supports include synthetic polymeric films, such as, polyethylene terephthalate, polycarbonate, polyvinylchloride, polystyrene, polyethylene, polypropylene, polyimide and polyethylene-2,6-naphthalene dicarboxylate. The above-described supports can be made opaque by incorporating pigments therein such as carbon black. Other supports include paper supports, such as photographic raw paper, printing paper, baryta paper and resin-coated paper having paper laminated with pigmented thermoplastic resins, fabrics, glass and metals. A subcoat may be added to the face of the support which carries the photosensitive materials to increase adhesion. For example, a polyester base coated with a gelatin subcoat has been found to enhance adhesion of aqueous-based layers. As is known in the art, the opaque support 10 may include antihalation materials. In an embodiment of the present invention wherein the support of the photosensitive element is transparent, a layer comprising a suitable light-absorbing material, such as, carbon black, is coated thereon before the antihalation layer to enable photographic processing outside the camera in ambient light without reexposure of the photosensitive silver halide layer.

Any suitable anti-reflection coating may be, and is preferably, provided on the outer surface of transparent support 36. Suitable anti-reflection coatings are widely known in the art and include those described in U.S. Pat. No. 3,793,022.

Polymeric acid layer 12 reduces the environmental pH of the film unit, subsequent to transfer image formation. As disclosed, for example, in U.S. Pat. No. 3,362,819, the polymeric acid layer may comprise a nondiffusible acid-reacting reagent adapted to lower the pH from the first (high) pH of the processing composition favorable for photographic development to a second (lower) pH less favorable for photographic development. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and a layer which comprises immobilized acid-reactive sites and which functions as a neutralization layer. Preferred polymers such a neutralization layer comprise such polymeric acids as cellulose acetate hydrogen phthalate; polyvinyl hydrogen phthalate; polyacrylic acid; polystyrene sulfonic acid; and maleic anhydride copolymers and half esters thereof.

Further, the polymeric acid layer can be applied, if desired, by coating the support layer with an organic solvent-based or water-based coating composition. A polymeric acid layer which is typically coated from an organic-based composition comprises a mixture of a half butyl ester of polyethylene/maleic anhydride copolymer with polyvinyl butyral. A suitable water-based composition for the provision of a polymeric acid layer comprises a mixture of a water soluble polymeric acid and a water soluble matrix, or binder, material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid layers, in addition to those disclosed in the aforementioned U.S. Pat. Nos. 3,362,819 and 3,756,815, mention may be made of those disclosed in U.S. Pat. Nos. 3,765,885; 3,819,371; 3,833,367 and 3,754,910.

Timing layer 14 is used in association with polymeric acid layer 12 to control or "time" the pH reduction so that it is not premature and does not interfere with the development process but may also act as a diffusion control interlayer. Any suitable timing layer may be used in the film units of the present invention. Suitable spacer or "timing" layers useful for this preferred purpose are well known in the relevant art, such as, for example, those described in U.S. Pat. Nos. 3,421,893; 3,575,701; 3,362,819; 4,201,587; 4,288,523; 4,297,431; 4,391,895; 4,426,481; 4,458,001; 4,461,824; 4,457,451 and 5,593,810. It is preferred to use a timing layer which includes a copolymer of butyl acrylate, diacetone acrylamide, carbomethoxy methyl acrylate, methyl methacrylate and methacrylic acid in the film units of the present invention.

Spacer layer 16 and interlayer 18 are employed as diffusion control interlayers and any such layers known in the art may be used in the film units of the invention. For example, the interlayer may include a suitable hardener for hardening a cross-linkable colloid such as gelatin. It is preferred to use an interlayer comprising a mixture of about 95 parts of a latex comprising 2-methyl-2-propenoic acid polymer with butyl 2-propenoate, N-(1,1-dimethyl)-3-oxybutyl), 2-propenoimide, ethyl benzene and 2-propenoic acid and about 5 parts of polyacrylamide, 1-hydroxymethyl-5,5-dimethylhydantoin and succindialdehyde. It is preferred that the spacer layer comprise gelatin.

Antihalation layer 20 is intended to: (a) allow a portion of the light speed to expose the film unit to reflect back into the emulsion layer and thus boost the speed of the film and (b) attenuate reflected light from the, e.g., opaque support, and he interfaces of the other layers between the anithalation layer and the, e.g., opaque support from reentering the photosensitive silver halide emulsion layer and thus causing a reexposure laterally displaced from the original point of entry resulting in halation.

As stated earlier, antihalation layer 20 comprises from about 1.5% to about 25% by weight of an antihalation material which need not be bleached, decolorized or removed during photographic processing, from about 30% to about 50% by weight of titanium dioxide and from about 25% to about 68.5% by weight of a binder, preferably, gelatin. It is preferred that the antihalation material is any suitable antihalation dye, or combination of antihalation dyes, known in the art. Antihalation materials typically render the antihalation layer visibly colored to some extent depending upon the nature and amount of the specific material employed. Film unit 8 of FIG. 1 is exposed and viewed through the transparent support of the image-receiving element. In addition, antihalation layer 20 is positioned in the photographic laminate 8*a* depicted in FIG. 2 between light-reflecting layer 28*a* and opaque support 10 whereas image-carrying layer 34*a* is adjacent transparent support 36 and between transparent support 36 and light-reflecting layer 28*a*. Based upon the location of antihalation layer 20 with respect to image-carrying layer 34*a*, it would be understood by those of skill in the relevant art that the antihalation material need not be decolorized or removed post-processing as it is shielded from view by light-reflecting layer 28*a*.

Any suitable antihalation material known in the relevant art for use in diffusion transfer photography may be employed in antihalation layer 20, such as, for example, any suitable antihalation material described in U.S. Pat. Nos. 2,543,181; 2,653,872; 2,977,226; 3,933,798; 4,088,487; 4,139,704; 4,140,689; 4,140,680; 4,186,001; 4,187,225; 4,210,752; 4,258,118; 4,258,119; 4,259,493; 4,277,406; 4,277,407; 4,282,160; 4,283,537; 4,283,538; 4,290,950; 4,290,951; 4,290,955; 4,304,833; 4,304,834; 4,307,017; 4,310,673; 4,311,847; 4,316,950; 4,345,017; 4,416,971; 4,429,142; and 4,617,402. As stated earlier, it is preferred to use an antihalation dye(s) as the antihalation material. It is particularly preferred to use a combination of magenta, cyan and yellow color filter dyes as the antihalation dyes, and a particularly preferred combination of such dyes is quinacridone red zeta (Violet 19), copper phthalocyanine and benzidine yellow, respectively.

Suitable antihalation dyes may be commercially obtained or prepared according to reactions which are well known by those skilled in the art and such reactions will be particularly apparent from the detailed descriptions of the preparation of various antihalation dyes which are provided in the Examples. In addition, any suitable form, e.g., anatase or rutile, of titanium dioxide, prepared using any suitable method, may comprise antihalation layer 20.

The antihalation materials and the titanium dioxide comprising antihalation layer 20 may be used in any amount within the ranges specified required to accomplish their intended purpose(s). The amount necessary in any specific instance is dependent upon a number of factors such as, for example, the specific antihalation material or form of titanium dioxide utilized, the type of photosensitive element and the result desired. Routine scoping tests may be conducted to ascertain the concentration which is appropriate for any given diffusion transfer black and white photographic film unit.

As stated earlier, the antihalation layer of the present invention comprises from about 1.5% to about 25% by weight of an antihalation material, from about 30% to about 50% by weight of titanium dioxide, and from about 25% to about 68.5% by weight of a binder. It is preferred that the antihalation layer of the invention comprise from about 5% to about 20% by weight of an antihalation material, from about 40% to about 48% by weight of titanium dioxide, and from about 32% to about 55% by weight of a binder. It is particularly preferred that the antihalation layer of the invention comprise about 12% by weight of an antihalation material, about 44% by weight of titanium dioxide, and about 44% by weight of a binder. Gelatin is the preferred binder.

It is preferred to provide the components of the antihalation layer of the invention in an amount calculated to provide a coated coverage in the range of from about 1500 $mg/M^2$ to about 2200 $mg/m^2$. In a preferred embodiment antihalation layer 20 includes about 400 $mg/m^2$ to about 1000 $mg/^2$ of titanium dioxide.

Photosensitive silver halide layer 22 may comprise any suitable photosensitive silver halide known in the art such as silver chloride, bromide, iodobrornide, chlorobromide, etc., and it may be prepared in situ or ex situ by any known method. It is preferred to use silver iodobrornide as the photosensitive silver halide. Any type of silver halide emulsion may be utilized, such as, for example, core shell, tabular, as well as, any of the variety of silver halide crystal shapes known in the art, e.g., cubic or octahedral.

The photosensitive silver halide comprising photosensitive silver halide layer 22 is typically prepared as an emulsion which is typically an aqueous emulsion, and any conventional silver halide precipitation techniques may be employed in the preparation of the emulsions. The silver halide emulsions may be spectrally sensitized by any suitable spectral sensitization technique to extend the photographic sensitivity to wavelengths other than those absorbed by the unsensitized silver halide. Examples of typical suitable sensitizing materials include cyanine dyes, merocyanine dyes, styryl dyes, hemicyanine dyes and oxanole dyes. In addition to spectral sensitization, the silver halide emulsions may be chemically synthesized using any known suitable chemical sensitization technique. Many chemical sensitization methods are known in the art. The film units of the present invention may include more than one photosensitive silver halide layers.

The silver halide emulsion is generally added to photosensitive silver halide layer 22 in an amount calculated to provide a coated coverage in the range from about 0.5 to about 15.0 mmol/$m^2$, and preferably from about 1.0 to about 8.0 mmol/$m^2$.

Any suitable silver halide solvent may be used in the film units of the present invention such as, for example, sodium or potassium thiosulfate, sodium thiocyanate and uracil. Also, a silver halide solvent precursor may be used.

Any suitable silver reducing agent may be used in the film units of the present invention, and these may be selected from among those commonly used in diffusion transfer photographic film units, such as, for example, reductic acid and its derivatives; hydroxylamine and its derivatives; hydroquinone and its derivatives, e.g., 2-chlorohydroquinone; aminophenol derivatives, e.g., 4-aminophenol and 3,5-dibromophenol; catechol and its derivatives, e.g., 3-methoxycatechol; phenylenediamine derivatives, e.g., N,N-diethyl-p-phenylenediamine; and 3-pyrazolidone derivatives, e.g., 1-phenyl-3-pyrazolidone and 4-hydroxymethyl-1-phenyl-3-pyrazolidone. The preferred silver reducing agents are 1-phenyl-3-pyrazolidone, commercially available under the tradename Phenidone, 4-hydroxymethyl-4-methyl-1-phenyl-3-pyrazolidone, commercially available under the tradename Dimezone-S, and graphidones. Also preferred are aminoreductones, such as, for example, those disclosed in U.S. Pat. No. 5,427,905. It is particularly preferred to use di(methoxyethyl) hydroxylamine as the silver reducing agent.

The reducing agents may be used singly or in combination and are generally employed in amounts ranging from about 0.5 to about 20.0 mmol/$m^2$, and preferably from about 8.0 to about 15.0 mmol/$m^2$.

The silver reducing agent(s) and the silver halide solvent (s) may be incorporated in photosensitive silver halide layer 22 together with the photosensitive silver halide, in a separate layer or layers of the film unit or, preferably, in processing composition 26 contained within rupturable container 28.

Photosensitive silver halide layer 22 and other layers of the film unit, specifically, photosensitive element 38 and image-receiving element 40, contain various materials as binders. Any suitable binder may be used in the layers of the film unit of the invention. Suitable binders include water-soluble synthetic high-molecular weight compounds, such as, for example, polyvinyl alcohol and polyvinylpyrrolidone, and synthetic or natural high-molecular weight compounds, such as, for example, gelatin, gelatin derivatives, cellulose derivatives, proteins, starches and gum arabic. A single binder or a mixture of binders may be used. Gelatin is the preferred binder for use in each layer. The amount of binder used in each layer is generally from about 0.5 to about 5.0 g/$m^2$, preferably from about 0.5 to about 2.0 g/$m^2$.

The layers of the film unit of the present invention which contain a crosslinkable colloid as a binder, e.g., gelatin, can be hardened by using any suitable organic and inorganic hardeners, such as, for example, those described in T. H. James, The Theory of the Photographic Process, 4th Ed., MacMillan, 1977, pp. 77–87. The hardeners can be used alone or in combination. It is preferred that the film units according to the present invention contain a hardener in interlayer 18. Any suitable hardener may be used in the film units of the present invention; however, aldehyde hardeners, e.g., 1-hydroxymethyl-5,5-dimethylhydantoin (Dantoin), succinaldehyde and glyoxal, have been found to be particularly useful when gelatin is employed as the binder. The hardeners are generally used in amounts ranging from about 1 to about 10% by weight of the gelatin coated and, preferably, about 6%.

Topcoat 24 is intended to be an anti-abrasion, anti-blocking or protective layer and may be of any suitable material known to accomplish that purpose such as, for example, gelatin in combination with a cross-linking material to prevent the gelatin from being softened during processing. Other materials such as polyacrylamide, polyvinylpyrrolidone and polyvinyl alcohol may be used in the topcoat. In addition, as is well known in the relevant art, other suitable materials may also be included in the topcoat layer of the present invention, such as, for example, tinuvin and silica, e.g., Silcron G100. It is preferred to use gelatin as the topcoat material. It is particularly preferred to use gelatin and polymethylmethacrylate (about 0.2 micron) as the topcoat material. It is also particularly preferred to use gelatin and silica as the topcoat material.

Overcoat 30 is intended to reduce the light-absorbing capacity of an optical filter agent(s) during photographic processing. The optical filter agent(s) are included in processing composition 26. The overcoat may comprise any suitable material known to perform such a function. It is preferred that the overcoat comprise nonylphenoxypolyoxyethylene, polyoxyethylene stearate and polyvinylpyrrolidone as disclosed in copending, commonly assigned U.S. patent application, Ser. No. 08/890,500 which was filed on Jul. 9, 1997.

Undercoat 32 is intended to (1) impart suitable adhesiveness to the film unit of the invention to prevent the coming apart of the film unit with time post-processing and (2) to tone the silver image of image-carrying layer 34*a*. Many suitable materials or, in effect, "glues," are known in the art to provide such adhesiveness, such as, for example, a carboxylated styrene-butadiene polymer latex as the glue, such as, for example, that which is commercially available under the tradename DL219. Materials suitable to tone the silver transfer image of the present invention to, e.g., enhance the stability of the silver image, are widely known in the art and any such material may be used in the undercoat. It is preferred to use a species formed from the combination of $HAuCl_3.3H_2O$ and thiocyanate salts as the toning agent. In addition, it is particularly preferred to include polyvinylpyrrolidone in the undercoat.

Image-receiving layer 34 comprises any suitable material which is adapted to effect catalytic reduction of solubilized silver halide. The composition of silver precipitating layers is well known in the art, and a wide variety of silver precipitating materials, or nuclei, may be used in a wide variety of matrix, or binder, materials. Such silver precipitating nuclei include heavy metals and heavy metal compounds such as the metals of Groups IB, IIB, IVA, VIA and VIII, and the reaction products of metals of Group IB, IIB, IVA and VIII with elements of Group VIA. Typical suitable silver precipitating nuclei are disclosed in U.S. Pat. Nos. 2,698,237 and 4,489,152 including metallic sulfides and selenides. Also suitable as silver precipitating agents are heavy metals such as silver, gold, platinum and palladium. Noble metals are typically preferred and are generally provided in a binder matrix as colloidal particles. The matrix, or binder, material may comprise a colloidal material such as gelatin, carboxymethylcellulose, a siliceous material and mixtures thereof. A particularly preferred image-receiving layer comprises colloidal palladium dispersed in colloidal silicas. Typically, the silver precipitating agents are present in a range of from about 1 to about 10 mg/$m^2$ and the binder material in the range of from about 5 to about 500 mg/$m^2$. A preferred binder to nuclei ratio is about 100:1. It is particularly preferred in the film units of the present invention that the image-receiving layer of the present invention comprise colloidal palladium dispersed in colloidal silica, a latex copolymer, polytetrafluoroethylene beads, 2-mercaptothiazoline, 2,4-dithiouracil, a gelatin dispersion of colloidal palladium nuclei and water, as disclosed in U.S. Pat. No. 4,489,152.

Rupturable container 28 is a pressure-rupturable container. Such pods and like structures are common in the art and generally define the means for providing the processing composition to the photosensitive element and the image-receiving element. Any suitable rupturable container may be incorporated in the film units of the present invention.

Processing composition 26 is distributed to the film unit of the invention from rupturable container 28 after exposure of photosensitive silver halide layer 22. Suitable processing compositions are widely known in the diffusion transfer art, and any suitable processing composition may be used in the film units of the present invention. The processing fluid typically contains a film-forming polymer adapted to provide viscosity suitable for distributing the processing fluid in a thin layer of substantially uniform thickness between the superposed sheet-like elements of the film unit. A preferred polymer is t-butyl acrylamide copolymer, although other polymers such as hydroxyethyl cellulose and sodium carboxymethyl cellulose also are suitable. Processing composition 26 includes an alkali, such as sodium or potassium hydroxide. As stated earlier, the silver reducing agent(s) and the silver halide solvent(s) may be included in the processing composition of the present invention. In addition, development restrainers, antifoggants, toning agents and any other suitable photographic additives for use in diffusion transfer photographic film units may be included in the processing composition of the present invention or, in one or more of the layers of the film unit of the present invention.

Figure 2:
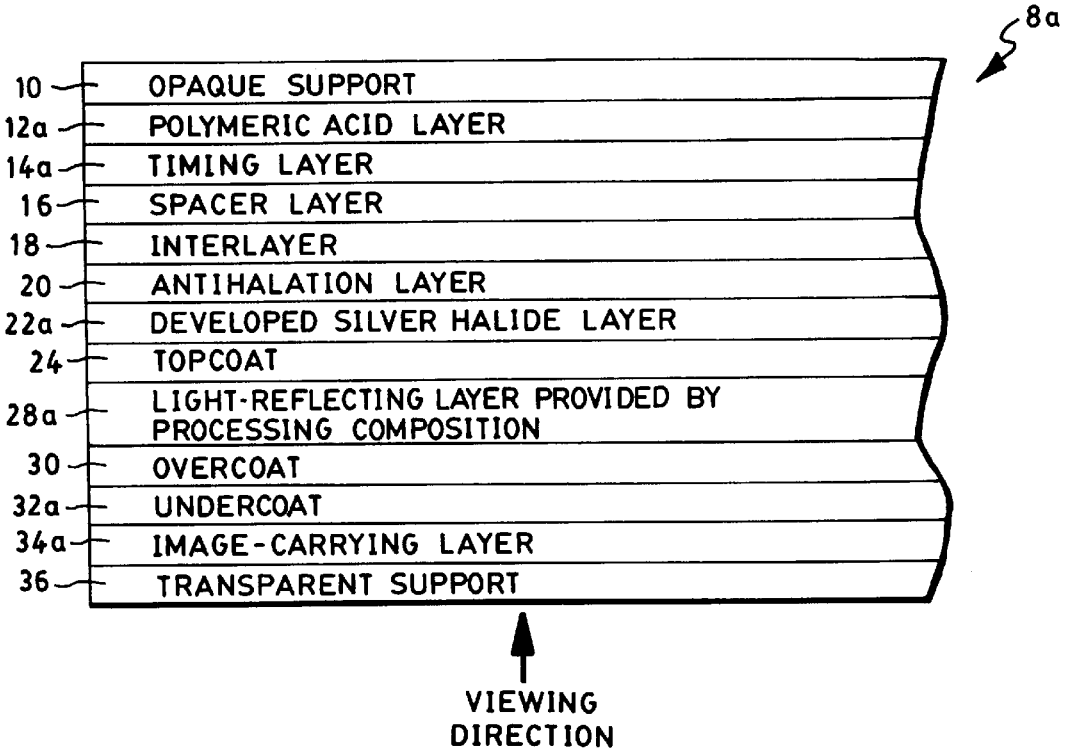
FIG. 2 is an enlarged schematic cross-sectional view of a photographic laminate of the present invention formed by the processing of the film unit of FIG. 1.

Referring now to FIG. 2, which shows a preferred photographic laminate 8*a* of the present invention formed by the processing of the film unit of FIG. 1, layers designated by numerals used to designate layers in FIG. 1 represent the same layers. Also, layers in FIG. 2 which are designated by numerals used to designate layers in FIG. 1 but now also include an "a" next to the numeral are intended to illustrate that these layers are not the same layers as in FIG. 1, but rather, that these layers have undergone some type of change from their initial state. More specifically, photosensitive silver halide layer 22 has been exposed and developed and, therefore, is designated developed silver halide layer 22*a*; polymeric acid layer 12 has neutralized the alkalinity of processing composition 26 and, therefore, is designated polymeric acid layer 12*a*; timing layer 14 has undergone hydrolysis to effect the pH drop, hence, is designated timing layer 14*a*; image-receiving layer 34 has received the silver transfer image and, therefore, is designated image-carrying layer 34*a*; and undercoat layer 32 has toned the silver transfer image residing in image-carrying layer 34*a* and, therefore, is designated 32*a*.

Light-reflecting layer 28*a* is formed by the solidification of the stratum of processing composition 26 distributed after exposure. Evaporation of water from the applied layer of processing composition results in solidified light-reflecting layer 28*a* which permits the viewing thereagainst of image-carrying layer 34*a* through transparent support 36. Light-reflecting layer 28*a* comprises an amount of a light-reflecting pigment sufficient to provide a suitable white background against which the final image is viewed, such as, for example, that amount delivered from a processing composition which includes, for example, from about 30% to about 60% by weight of a light-reflecting pigment, preferably, titanium dioxide, which would be understood by those of skill in the relevant art to result in a coating of from about 20,000 to about 40,000 mg/m$^2$ of titanium dioxide. In addition, light-reflecting layer 28*a* serves to laminate together developed silver halide layer 22*a* and image-carrying layer 34*a* to provide a final photographic laminate, such as, the preferred laminate 8*a* depicted in FIG. 2 herein.

It should be noted that the film units of the invention may include other materials which are well known in the art for use in such film units. Such other materials include, for example, antifoggants, releasable antifoggants, antistatic agents, coating aids such as surfactants, activators and the like.

The invention will now be described further in detail with respect to a specific preferred embodiment by way of an example, it being understood that these are intended to be illustrative only and the invention is not limited to the materials, procedures, amounts, etc. recited therein. All parts and percentages recited are by weight unless otherwise stated.

EXAMPLE

Two diffusion transfer photographic film units were prepared. More specifically, a "control" photosensitive element was prepared by coating the following layers, in succession, onto an opaque, i.e., carbon black filled, subcoated polyethylene terephthalate film of approximately 4 mil thickness:

1. a polymeric acid layer comprising about 28,520 mg/m$^2$ of a mixture of about 4 parts of a half-butyl ester of poly(ethylene/maleic anhydride) copolymer and about 1 part of polyvinyl butyral;
2. a timing layer comprising a 49.1/30.0/10.0/7.2/3.7 copolymer of butyl acrylate/diacetone acrylamidelcarbomethoxy methyl acrylate/methyl methacrylate/methacrylic acid, in water, coated at a coverage of about 7500 mg/m$^2$;
3. a spacer layer comprising about 1600 mg/m$^2$ of gelatin;
4. an interlayer comprising about 3000 mg/m$^2$ of a mixture of about 95 parts of a latex comprising 2-methyl-2-propenoic acid polymer with butyl 2-propenoate, N-(1,1-dimethyl)-3-oxybutyl), 2-propenoimide, ethyl benzene and 2-propenoic acid and about 5 parts of polyacrylamide, about 345 mg/m$^2$ of 1-hydroxymethyl-5,5-dimethylhydantoin and about 10 mg/m$^2$ of succindialdehyde;
5. an antihalation layer comprising about 800 mg/m$^2$ of gelatin and about 220 mg/m$^2$ of about 80/100/40 of benzidine yellow/quinacridone red zeta Violet 19)/copper phthalocyanine;
6. a photosensitive silver halide layer comprising about 650 mg/m$^2$ of silver iodobromide (1.0 microns) and about 2000 mg/m$^2$ of gelatin; and
7. a topcoat layer comprising about 467 mg/n$^2$ of gelatin and about 600 mg/m$^2$ of polymethylmethacrylate (about 0.2 micron).

The photosensitive element utilized in the "test" diffusion transfer photographic film unit was the same as described above except that layer 5, i.e., the antihalation layer, further included about 800 mg/m$^2$ of titanium dioxide.

The image-receiving element used in each of the film units described above was prepared by coating the following layers, in succession, onto a transparent polyethylene terephthalate film of approximately 3.5 mil thickness:

1. an image-receiving layer comprising about 1.4 mg/sq.m of colloidal palladium using a coating solution comprising about 60.13 g of a colloidal silica dispersion (about 30% silica), about 5.7 g of a 60.6/29/6.3/3.7/0.4 latex copolymer of butylacrylate, diacetone acrylamide, styrene, methacrylic acid and acrylic acid, about 2.35 g of about 0.5 micron polytetrafluoroethylene beads, about 0.034 g of 2-mercaptothiazoline, about 0.017 g of 2,4-dithiouracil, about 4.55 g of a gelatin dispersion of colloidal palladium nuclei (about 0.62% palladium) and about 875 g of water;

2. an undercoat layer comprising about 100 mg/m$^2$ of polyvinylpyrrolidone, about 60 mg/m$^2$ of a 60.6/29/6.3/3.7/0.4 latex copolymer of butylacrylate, diacetone acrylamide, styrene, methacrylic acid and acrylic acid, and about 3 mg/m$^2$ of gold delivered as a species derived from $HAuCl_3.3H_2O$ and potassium thiocyanate; and 3. an overcoat layer comprising about 15 mg/M$^2$ of polyvinylpyrrolidone, about 43 mg/m$^2$ nonylphenoxypoly(ethyleneoxy)ethanol and about 42 mg/m$^2$ of an ammoniated 1/1/0.1/0.1 tetrapolymer of diacetone acrylamide, methylacrylic acid, butylacrylate and styrene.

For each of the film units, the photosensitive element was placed in a superposed relationship with the image-receiving element with their respective supports outermost and a rupturable container retaining an aqueous alkaline processing composition fixedly mounted at the leading edge of the superposed elements, by pressure-sensitive or heat-sensitive tapes to make a film unit, so that, upon application of compressive force to the container to rupture the marginal seal of the container, the contents thereof would be distributed between the superposed elements. The chemical composition of the aqueous alkaline processing composition utilized for the processing of the film units is set forth in TABLE I.

TABLE I

| COMPONENT | PARTS BY WEIGHT |
|---|---|
| potassium hydroxide | 6.6 |
| titanium dioxide | 42.8 |
| uracil | 2.7 |
| di(methoxyethyl)hydroxylamine | 1.2 |
| 2-mercaptothiazoline | 0.003 |
| optical filter agent[1] | 1.4 |
| triethanolamine | 0.2 |
| 3,4,5,6-tetrahydropyrimidine 2-thiol | 0.001 |
| potassium thiosulfate | 0.02 |
| optical filter agent[2] | 0.3 |
| colloidal silica | 0.6 |
| optical filter agent[3] | 0.13 |
| t-butyl acrylamide copolymer | 1.0 |
| water | balance to 100 |

1

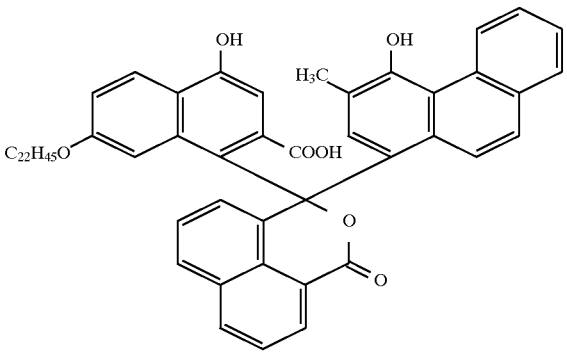

TABLE I-continued

| COMPONENT | PARTS BY WEIGHT |
|---|---|

2

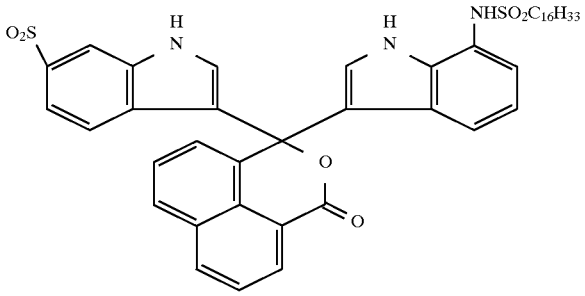

3

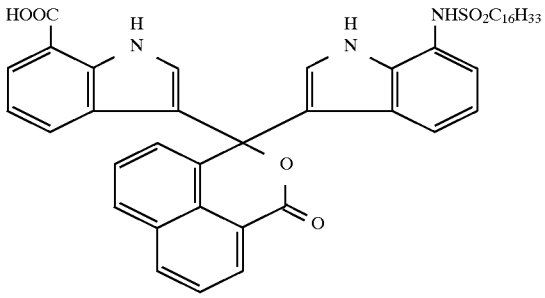

Each film unit, after exposure to a sensitometric target, was passed through a pair of rollers set at a gap spacing of about 0.007 mm, at room temperature. The final images were viewed through their respective transparent supports of their respective image-receiving elements.

The minimum ($D_{min}$) and maximum ($D_{max}$) reflection densities of the silver image of both film units were read on a MacBeth Densitometer, and the data are reported in TABLE II.

TABLE II

| FILM UNIT | $D_{max}$ | $D_{min}$ |
|---|---|---|
| Control | 195 | 0.19 |
| Test | 193 | 0.21 |

It can be seen from the $D_{max}$ values reported in TABLE II that both the "control" and the "test" film units provide a silver image of suitable density in their respective image-carrying layers. As would also be appreciated by one of skill in the art from the $D_{min}$ data reported in TABLE II, the antihalation layer prepared according to the present invention provides substantially the same suitable background as the control. Hence, a diffusion transfer photographic film unit prepared according to the present invention provides an acceptable photograph, i.e., a final photograph of suitable silver image density and background.

In addition, the film of each of the "control" and "test" diffusion transfer photographic film units was measured and would be well understood by those of skill in the relevant art to represent the relative exposure necessary to produce a 0.6 visual density, i.e., the amount of light to provide a greyish image discemable to the viewer's eye. Moreover, as will be appreciated by those of skill in the art, an increase in speed was measured by calculating the log relative exposure (in meter candle second (mcs) at constant exposure) necessary to produce the 0.6 visual density. Briefly, both the "control" and the "test" film units of this example were exposed with the same amount of light, i.e., about 0.5 mcs, through a filter of gradations, and then processed as described above. The film speed data are reported in TABLE III, and one stop is equal to about 30 units of film speed.

TABLE III

| FILM UNIT | FILM SPEED |
|---|---|
| Control | about 122 |
| Test | about 146 |

As will be appreciated by those of skill in the art from the data reported in TABLE III, an antihalation layer prepared according to the present invention provides a faster film, i.e., the film speed for the "test" film unit is about 146 and the film speed for the "control" film unit is about 122; hence, the differential is about 23 which represents slightly less than a two-fold increase in film speed or a gain of about one stop.

In addition, the resolution, i.e., a measurement of the number of lines that can be resolved by the "control" and "test" diffusion transfer photographic film units was measured in "line pairs per millimeter." Briefly, as would be well understood by those of skill in the art, the film units were exposed to different amounts of light, specifically, plus and minus about 0.5 stop or about 15 units, with a visual readout incorporated therein, namely, an Air Force Resolution 3 Bar Target, and processed as described above. The resultant diffusion transfer film units were examined using a stereoscope for their ability to resolve the line pairs. As would be well understood, the greater the number of line pairs, the higher the resolving power, or visually perceived sharpness, of the film. The resolution data are reported in TABLE IV.

TABLE IV

| FILM UNIT | LINE PAIRS PER MILLIMETER |
|---|---|
| Control | about 8 |
| Test | about 10.1 |

As will be appreciated by those of skill in the art from the data reported in TABLE IV, an antihalation layer prepared according to the present invention provides an image of increased resolution, i.e., the resolution for the "test" film unit is about 10.1 and the resolution for the "control" film unit is about 8. In addition, when viewed by the photographer, the final image of the "test" film unit provides an image of perceptively greater sharpness than the image provided by the "control" film unit. Hence, film units prepared according to the present invention provide suitable resolution, e.g., suitable antihalation, and suitable film speed, and, in fact, an increase in film speed.

As will be understood by those of skill in the art from the data reported in TABLES m and IV, the "test" film unit provides an increase in film speed along with an image of enhanced resolution. Those of skill in the art will understand that an increase in film speed through the incorporation of a layer according to the present invention may also bring about other distinct but interrelated advantages. For example, where such a film speed increasing layer is incorporated in the film unit, it will be understood by those of skill in the art that a concomitant decrease in silver halide grain size is then permissible. In other words, as would be appreciated by one of skill in the art, decreasing the grain size should result in a "slower" emulsion which will offset the film speed increase due to the incorporation of the film speed increasing layer, but will also result in less granularity as visually perceived from viewing the final image.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A diffusion transfer photosensitive black and white film unit comprising:

a photosensitive element comprising an opaque support and carrying, in succession, an antihalation layer comprising from about 1.5% to about 25% by weight of an antihalation material, from about 30% to about 50% by weight of titanium dioxide and from about 25% to about 68.5% by weight of a binder, and at least one photosensitive silver halide layer;

an image-receiving element comprising a transparent support and carrying an image-receiving layer comprising silver nucleating material, said image-receiving element in superposed relationship or adapted to be placed in superposed relationship with said photosensitive element so as to receive image silver released from said photosensitive element upon photoexposure and development;

means providing an aqueous alkaline processing composition for initiating said development of said photosensitive silver halide after said photoexposure to form an image on said image-receiving layer, wherein said processing composition comprises an amount of a light-reflecting pigment capable of forming a light-reflecting layer during photographic processing which provides a white background against which to view the final image;

a silver halide solvent; and a silver reducing agent.

2. A diffusion transfer photosensitive black and white film unit as defined in claim 1 wherein said antihalation layer comprises from about 5% to about 20% by weight of an antihalation material.

3. A diffusion transfer photosensitive black and white film unit as defined in claim 1 wherein said antihalation layer comprises from about 40% to about 48% by weight of titanium dioxide.

4. A diffusion transfer photosensitive black and white film unit as defined in claim 1 wherein said antihalation layer comprises from about 32% to about 55% by weight of a binder.

5. A diffusion transfer photosensitive black and white film unit as defined in claim 1 wherein said antihalation layer comprises about 12% by weight of an antihalation material, about 44% by weight of titanium dioxide and about 44% by weight of a binder.

6. A diffusion transfer photosensitive black and white film unit as defined in claim 1 wherein said silver halide solvent is selected from the group consisting of uracil and potassium thiosulfate.

7. A diffusion transfer photosensitive black and white film unit as defined in claim 1 wherein said silver reducing agent is di(methoxyethyl)hydroxylamine.

8. A diffusion transfer photosensitive black and white film unit as defined in claim 1 wherein said silver halide solvent and said silver reducing agent are included in said processing composition.

9. A diffusion transfer photosensitive black and white film unit as defined in claim 1 wherein said light-reflecting pigment is titanium dioxide.

10. A diffusion transfer photosensitive black and white film unit as defined in claim 1 wherein said antihalation material is a color filter dye.

11. A diffusion transfer photosensitive black and white film unit as defined in claim 1 further including a polymeric acid layer and a timing layer.

12. A diffusion transfer photosensitive black and white film unit as defined in claim 1 wherein said photosensitive element further includes a topcoat layer.

13. A diffusion transfer photosensitive black and white film unit as defined in claim 1 wherein said image-receiving element further includes an undercoat layer and an overcoat layer.

14. A diffusion transfer photosensitive black and white film unit as defined in claim 11 wherein said polymeric acid layer comprises a half-butyl ester of poly(ethylene/maleic anhydride) copolymer and polyvinyl butyral.

15. A diffusion transfer photosensitive black and white film unit as defined in claim 11 wherein said timing layer comprises a copolymer of butyl acrylate, diacetone acrylamide, carbomethoxy methyl acrylate, methyl methacrylate and methacrylic acid.

16. A diffusion transfer photosensitive black and white film unit as defined in claim 12 wherein said topcoat layer comprises gelatin and polymethylmethacrylate.

17. A diffusion transfer photosensitive black and white film unit as defined in claim 16 wherein said topcoat layer further includes silica.

18. A diffusion transfer photosensitive black and white film unit as defined in claim 13 wherein said undercoat layer comprises polyvinylpyrrolidone, a latex copolymer of butylacrylate, diacetone acrylamide, styrene, methacrylic acid and acrylic acid, and a silver image toning agent.

19. A diffusion transfer photosensitive black and white film unit as defined in claim 18 wherein said silver image toning agent is a species derived from $HAuCl_3.3H_2O$ and potassium thiocyanate.

20. A diffusion transfer photosensitive black and white film unit as defined in claim 13 wherein said overcoat layer comprises polyvinylpyrrolidone, nonylphenoxypoly (ethyleneoxy)ethanol and an ammoniated tetrapolymer of diacetone acrylamide, methylacrylic acid, butylacrylate and styrene.

21. A diffusion transfer photosensitive black and white film unit as comprising:

a photosensitive element comprising an opaque support and carrying, in succession, a polymeric acid layer, a timing layer, a spacer layer, an interlayer, an antihalation layer comprising from about 1.5% to about 25% by weight of an antihalation material, from about 30% to about 50% by weight of titanium dioxide and from about 25% to about 68.5% by weight of a binder, a photosensitive silver halide layer and a topcoat layer;

an image-receiving element comprising a transparent support and carrying, in succession, an image-receiving layer comprising silver nucleating material, an undercoat layer and an overcoat layer, said image-receiving element in superposed relationship or adapted to be placed in superposed relationship with said photosensitive element so as to receive image silver released from said photosensitive element upon photoexposure and development;

means providing an aqueous alkaline processing composition for initiating said development of said photosensitive silver halide after said photoexposure to form an image on said image-receiving layer, wherein said processing composition comprises an amount of titanium dioxide capable of forming a light-reflecting layer during photographic processing which provides a white background against which to view the final image;

a silver halide solvent; and a silver reducing agent.

* * * * *